US008011992B2

(12) United States Patent
Ejima

(10) Patent No.: US 8,011,992 B2
(45) Date of Patent: Sep. 6, 2011

(54) TRANSFORMABLE TOY

(75) Inventor: Takio Ejima, Tokyo (JP)

(73) Assignee: Tomy Company, Ltd., Tokyo (JP)

( * ) Notice: Subject to any disclaimer, the term of this patent is extended or adjusted under 35 U.S.C. 154(b) by 340 days.

(21) Appl. No.: 12/379,118

(22) Filed: Feb. 12, 2009

(65) Prior Publication Data

US 2009/0209168 A1 Aug. 20, 2009

(30) Foreign Application Priority Data

Feb. 14, 2008 (JP) ..... 2008-32549

(51) Int. Cl.
*A63H 17/00* (2006.01)
*A63H 3/46* (2006.01)

(52) U.S. Cl. ..... 446/93; 446/95; 446/99; 446/376; 446/487

(58) Field of Classification Search ..... 446/93–95, 446/97, 99, 320, 321, 376, 487
See application file for complete search history.

(56) References Cited

U.S. PATENT DOCUMENTS

| | | | | |
|---|---|---|---|---|
| 4,170,840 | A | 10/1979 | Ogawa | |
| 4,206,564 | A | 6/1980 | Ogawa | |
| 4,214,402 | A | 7/1980 | Ogawa | |
| 4,391,060 | A | 7/1983 | Nakane | |
| 4,516,948 | A | 5/1985 | Obara | |
| 4,571,201 | A | 2/1986 | Matsuda | |
| 4,571,203 | A * | 2/1986 | Murakami | 446/95 |
| 4,575,352 | A | 3/1986 | Matsuda | |
| 4,578,046 | A * | 3/1986 | Ohno | 446/376 |
| 4,580,993 | A * | 4/1986 | Ohno | 446/376 |
| 4,583,958 | A | 4/1986 | Matsuda | |
| 4,586,911 | A * | 5/1986 | Murakami | 446/376 |
| 4,623,317 | A * | 11/1986 | Nagano | 446/289 |
| 4,674,990 | A * | 6/1987 | Ohno | 446/376 |
| 4,680,018 | A * | 7/1987 | Ohno | 446/376 |
| D292,109 | S * | 9/1987 | Lim | D21/581 |
| D293,805 | S * | 1/1988 | Matsumoto | D21/582 |
| 4,750,895 | A * | 6/1988 | Shinohara et al. | 446/230 |
| 7,785,168 | B2 * | 8/2010 | Yamada et al. | 446/376 |
| 2009/0209167 | A1 * | 8/2009 | Ejima | 446/93 |

FOREIGN PATENT DOCUMENTS

| | | |
|---|---|---|
| JP | 9-10442 | 1/1997 |
| JP | 09010442 A * | 1/1997 |
| JP | 9-28933 | 2/1997 |

OTHER PUBLICATIONS

Patent Abstracts of Japan, Publication No. 09-010442, Published Jan. 14, 1997. Patent Abstracts of Japan, Publication No. 09-028933, Published Feb. 4, 1997.

* cited by examiner

*Primary Examiner* — Gene Kim
*Assistant Examiner* — Scott Young
(74) *Attorney, Agent, or Firm* — Staas & Halsey LLP

(57) ABSTRACT

A transformable toy which can be automatically transformed despite its appearance in which members are merely pivotably connected as in conventional transformable toys is provided. Front end portions of a first base member and a second base member, as well as rear end portions of the first and second base members, are pivotably connected by first and second link members, respectively. The second base member is urged by an elastic force of a first elastic member, provided on at least one connecting portion, to move forwardly with respect to the first base member. Figure members expressing states differing between first and second configurations are connected to the first base member and the first link member. Connecting portions of figure members have second elastic members acting against the elastic force of the first elastic member and having an elastic force set to be smaller than that of the first elastic member.

5 Claims, 8 Drawing Sheets

TRANSFORMABLE TOY

BACKGROUND OF THE INVENTION

1. Field of the Invention

The present invention relates to a transformable toy which is reversibly transformed between two configurations, from a first configuration such as a vehicle or an animal to a second configuration, or vice versa, and more particularly to a transformable toy which can be automatically transformed by using an elastic force of an elastic member.

2. Description of the Related Art

Conventionally, when a transformable toy is transformed during play, it has been required that each constituent part be manually operated and operating procedures have been complicated. Therefore, a transformable toy which can be transformed by a simple operation has been proposed (see, for example, Japanese Patent Application Laid-Open Publication No. 9-10442). In this transformable toy, a first configuration is a vehicle configuration, a second configuration is a robot configuration, and a rear member is provided with a sliding member in a forwardly and backwardly slidable manner, the sliding member being formed with a rack, being partly exposed above the rear member, and having an operating element mounted thereon. When the sliding member is slid forwardly by operation of the operating element, the rack formed on the sliding member slides forwardly. A gear formed at an end portion of one of two connecting links is in mesh with the rack, and the connecting links pivot about respective pivoting shafts and are thus folded. A front member is pivotably connected to the other of the connecting links, and since the front member is foldably connected to the rear member, the front member is folded with respect to the rear member, and the front member and the rear member constitute a trunk portion in the robot configuration, the trunk portion being part of a second configuration.

In the above-described transformable toy, the sliding member is formed with a rack, one of the connecting links is provided with a gear meshing with the rack, and the connecting links are driven by a sliding operation of the sliding member. Accordingly, the above-described transformable toy inevitably requires a gear, which has not been present in conventional transformable toys, and has problems that a gear is exposed and deteriorates the appearance of the toy and that manufacturing and assembly costs increase as the number of transforming regions increases, because the number of gears to be meshed also increases.

SUMMARY OF THE INVENTION

The present invention has been made in order to solve the above problems. An object of the present invention is to provide a transformable toy, based on a new idea, which can be automatically transformed without the use of a gear despite its appearance in which main members are merely pivotably connected as in conventional transformable toys.

In order to solve the foregoing problems, according to the present invention, there is provided a transformable toy reversibly transformed from a first configuration to a second configuration. The transformable toy includes a first base member; a second base member disposed at a predetermined distance from the first base member; a first link member for pivotably connecting a front end portion of the first base member and a front end portion of the second base member; a second link member for pivotably connecting a rear end portion of the first base member and a rear end portion of the second base member; a first elastic member provided at a connecting portion between at least one of the first link member and the second link member and at least one of the first base member and the second base member, one of the link members being urged to pivot by an elastic force of the first elastic member, relative positions of the first base member and the second base member being changed by pivoting of the one of the link members; at least one figure member connected to any or all of the first base member, the second base member, the first link member, and the second link member, the at least one figure member expressing a state differing between the first configuration and the second configuration; and a second elastic member provided at a connecting portion between the figure member and the first base member, the second base member, the first link member, or the second link member, the second elastic member acting against the elastic force of the first elastic member, the second elastic member having an elastic force set to be smaller than the elastic force of the first elastic member. The transformable toy is transformed from the first configuration to the second configuration by using the elastic force of the first elastic member.

Preferably, the first configuration of the transformable toy is a running object; the second configuration thereof is a robot; the first base member constitutes a waist portion in the robot configuration; the second base member constitutes a back portion; the second base member has a head portion of the robot at an end thereof; the at least one figure member includes a pair of first figure members, the pair of first figure members being connected to the first link member and constituting a bumper portion in the running-object configuration, the first figure members each being pivoted outwardly against the force of the second elastic member and constituting an arm portion in the robot configuration, when the second base member moves forwardly; and the at least one figure member includes a second figure member, the second figure member being connected to the first base member and constituting a front portion in the running-object configuration, the second figure member being pivoted forwardly against the force of another second elastic member and constituting a chest portion in the robot configuration, when the second base member moves forwardly.

Moreover, preferably, each of the first figure members is connected to a supporting plate pivotably supported on the first link member; and the second base member has an engaging plate for engaging with the supporting plate, the engaging plate engaging with the supporting plate and pivoting the supporting plate outwardly, thereby constituting an arm portion in the robot configuration, when the second base member moves forwardly.

Further, preferably, the transformable toy includes a lock member provided in an engageable and disengageable manner, the lock member fixing one of the link members to prevent pivoting thereof, against the elastic force of the first elastic member.

According to the present invention, it is possible to provide a transformable toy, based on a new idea, which can be automatically transformed and can give the user a surprise despite its appearance, and which is similar to conventional transformable toys since anything unrelated to configuration, such as a gear, is invisible during transformation, because all main members are merely pivotably connected without a gear or the like therebetween.

Moreover, when the transformable toy is transformed from a first configuration to a second configuration by means of the elastic force of the first elastic member, the elastic force of the second elastic member is not exerted. However, when the configuration is restored from the second configuration to the first configuration by retracting the second base member against the elastic force of the first elastic member, by using an external force, the elastic force of the second elastic member is exerted and figure members can be automatically returned to their original positions.

According to one embodiment of the present invention, when the transformable toy is transformed from a running-object configuration to a robot configuration, one movement of the second base member, which is a forward movement, produces movements of figure members, and therefore, when the movement of the second base member has been completed, the movements of the figure members have also been completed, completing the robot configuration.

DESCRIPTION OF THE PREFERRED EMBODIMENT

Figure 1:
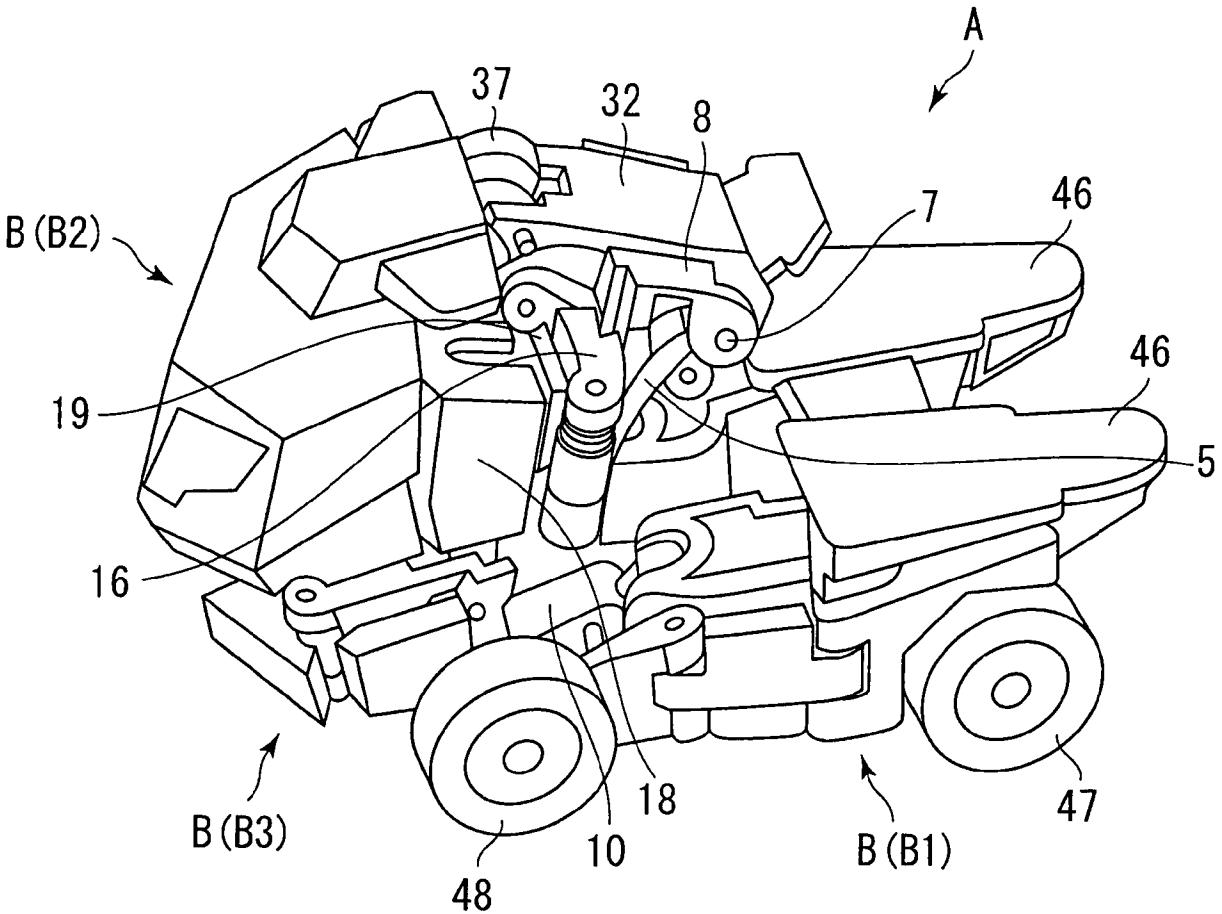
FIG. 1 is a perspective view showing a first configuration of a transformable toy of the present invention.
Figure 2:
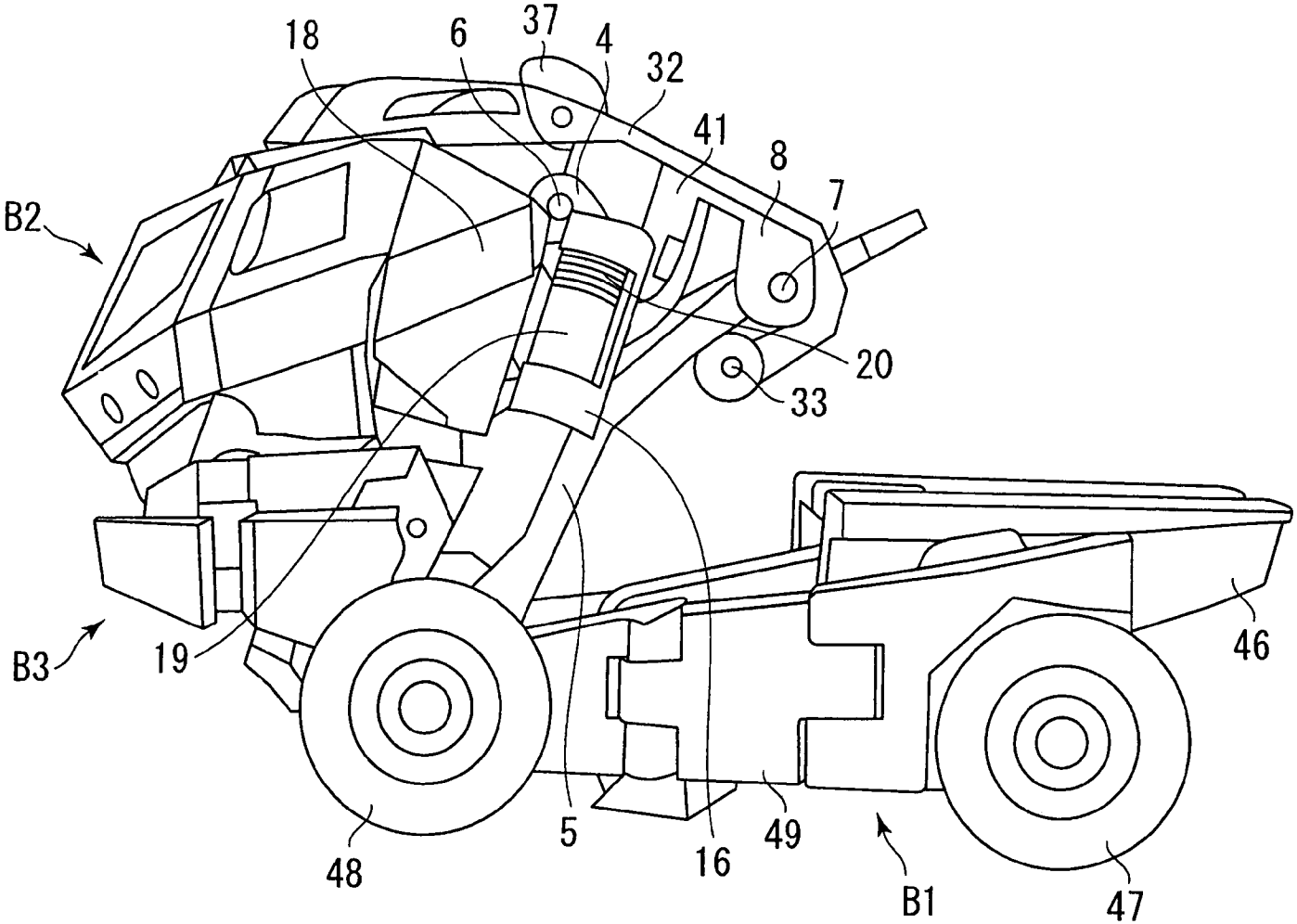
FIG. 2 is a side view showing the first configuration of the transformable toy.
Figure 3:
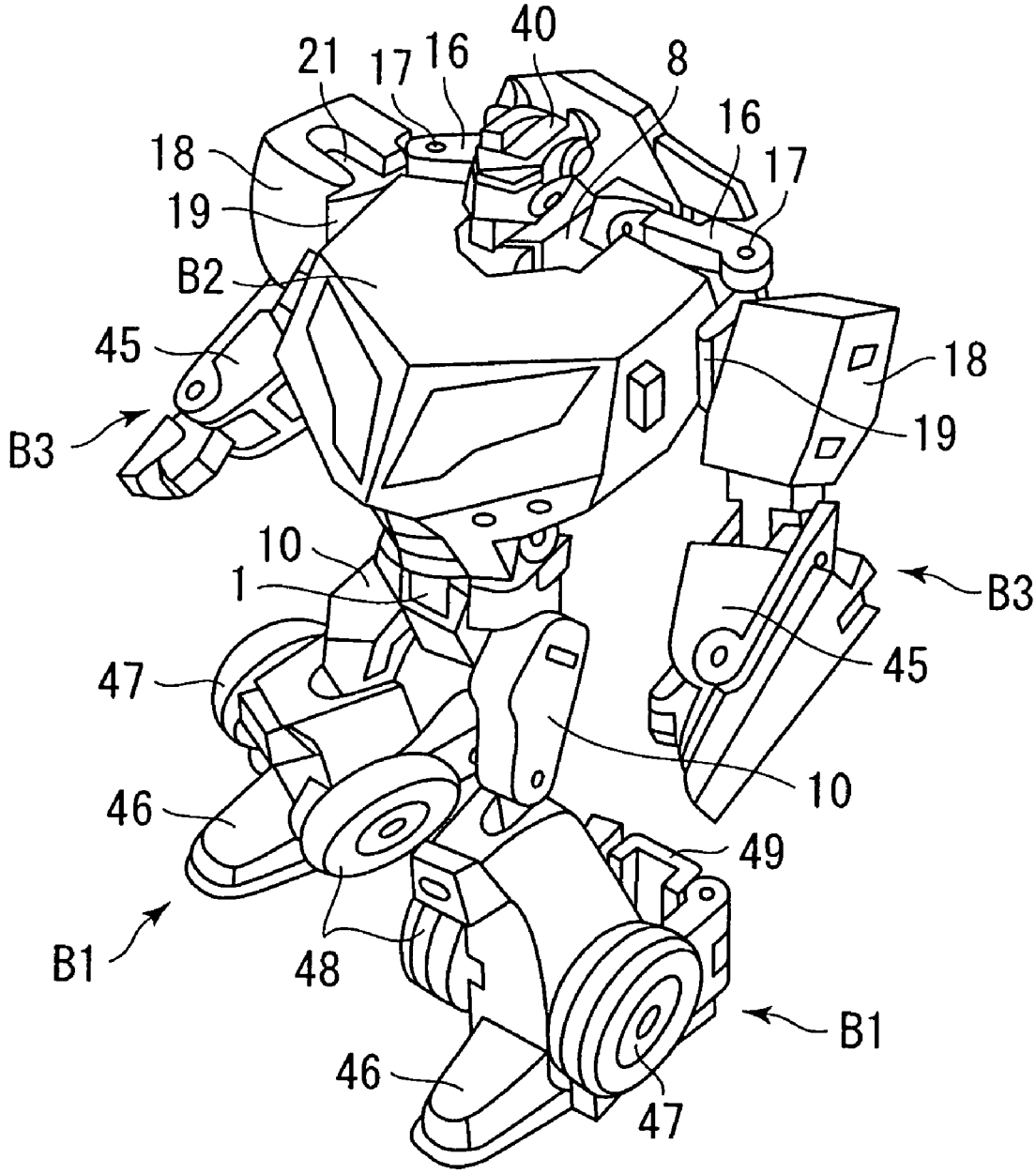
FIG. 3 is a perspective view showing a state of the transformable toy which has been transformed into a second configuration.

FIGS. 1 and 2 are a perspective view and a side view showing one example of a first configuration of a transformable toy A according to the present invention, in which the first configuration is a running-object configuration, and the running object is formed to simulate a tractor for towing a trailer. FIG. 3 shows a second configuration of the transformable toy A, in which the second configuration is a robot configuration.

Figure 4:
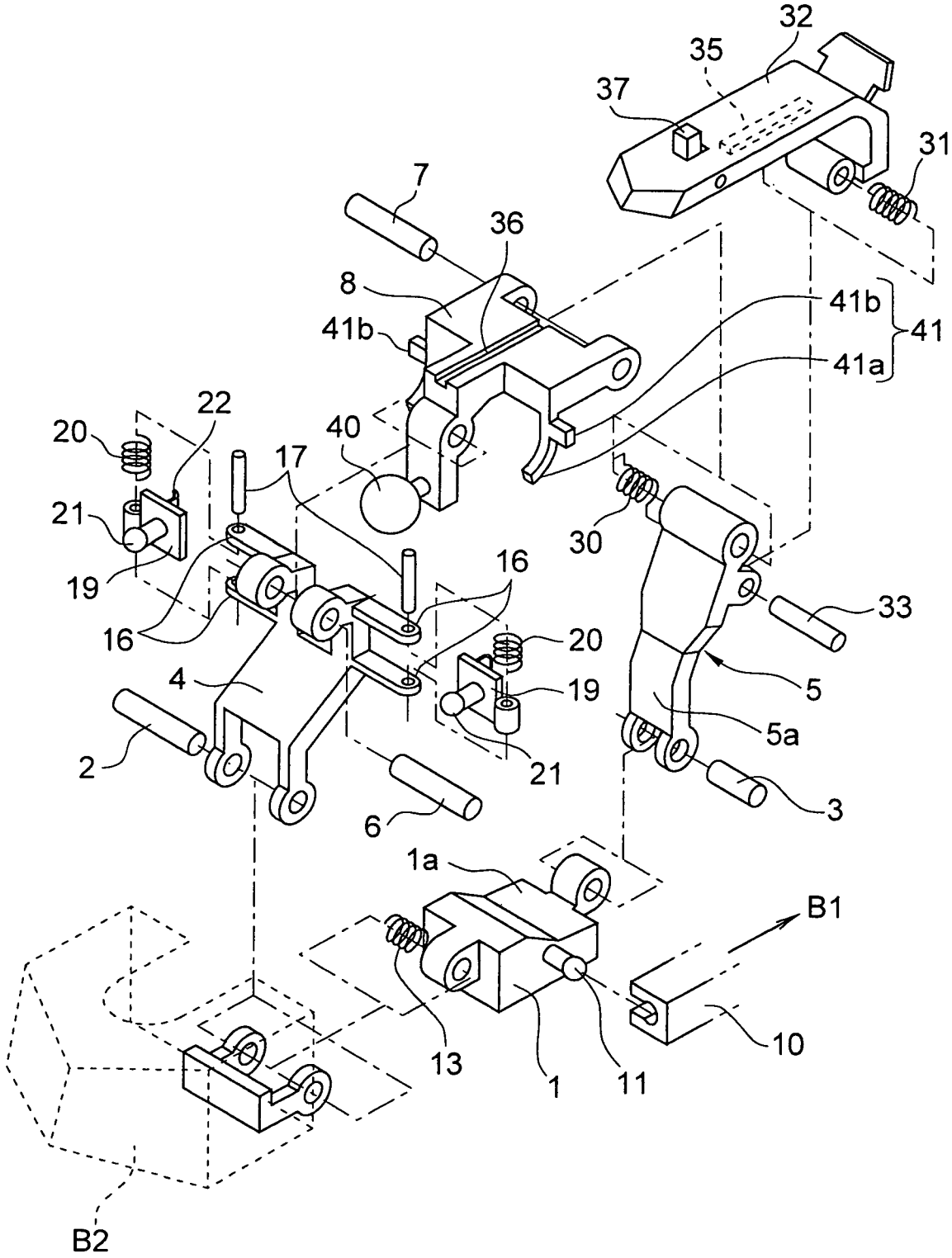
FIG. 4 is an exploded perspective view showing a construction of basic portions of the transformable toy.

FIG. 4 shows a construction of basic portions of the transformable toy A, in which the transformable toy A includes a first base member 1 (constituting a waist portion in the robot configuration); a first link member 4 and a second link member 5 having one end pivotably connected through shafts 2 and 3 to a front end portion and a rear end portion of the first base member 1, respectively; and a second base member 8 (constituting a back portion in the robot configuration) pivotably connected through shafts 6 and 7 to the other ends of the first link member 4 and the second link member 5 and provided parallel to the first base member 1 at a predetermined distance therefrom. The transformable toy A is constructed so that the second base member 8 can move in forward and backward directions with respect to the first base member 1 when the first link member 4 and the second link member 5 pivot.

The first base member 1 has connecting shafts 11 formed to protrude at both side portions thereof. The connecting shafts 11 are provided for pivotably connecting connecting members 10 (constituting thigh portions in the robot configuration) for connecting figure members B (hereinafter referred to as "leg portions B1"), which are formed to simulate a chassis (constituting leg portions in the robot configuration) of a tractor in the running-object configuration, and the first base member 1. A figure member B (hereinafter referred to as "chest portion B2") formed to simulate a driver's cab (constituting a chest portion in the robot configuration), which is a front portion of the tractor in the running-object configuration, is vertically pivotably connected to a front portion of the first base member 1 by a shaft 2. The chest portion B2 is urged by a second elastic member (hereinafter referred to as "return spring") 13 to pivot upwardly with respect to the first base member 1.

The first link member 4 is mounted in a forwardly and backwardly pivotable manner at the front portion of the first base member 1 by the shaft 2, together with the chest portion B2. The first link member 4 is pivotably connected at an upper portion thereof to a front end portion of the second base member 8 by the shaft 6 and is formed at both side portions thereof with supporting portions 16 for supporting figure members B (hereinafter referred to as "arm portions B3"), which are formed to simulate a front bumper (constituting arm portions in the robot configuration) of the tractor in the running-object configuration. The supporting portions 16 each support a supporting plate 19, which pivotably supports an upper arm portion 18 of each of the arm portions B3 by a shaft 17 so as to be pivotable in a horizontal direction with respect to the first link member 4.

Figure 6A:
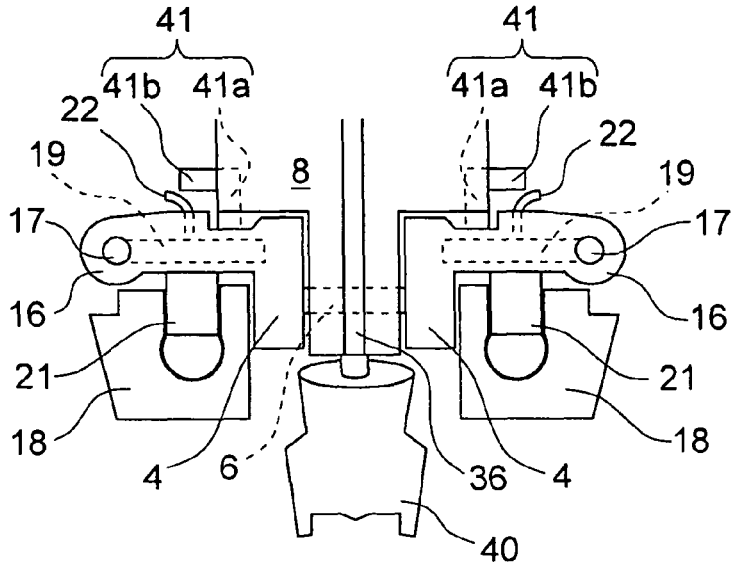
FIGS. 6A to 6C are explanatory diagrams showing changes in the state of arm portions.

The supporting plate 19 is urged by another second elastic member (hereinafter referred to as "return spring") 20 to pivot inwardly about the shaft 17. The supporting plate 19 has a connecting shaft 21 formed to protrude forwardly on a front surface thereof, which connecting shaft 21 pivotably connects the upper arm portion 18 of each of the arm portions B3 simulating a front bumper (constituting arm portions in the robot configuration) of the tractor in the running-object configuration. The supporting plate 19 has an engaging lug 22 formed to protrude on a back surface thereof, which engaging lug 22 pivots the supporting plate 19 outwardly about the shaft 17 by being pressed by an engaging plate 41 provided on the second base member 8, which will be described later (see FIG. 6A).

The second link member 5 is connected at a lower end thereof to a rear end portion of the first base member 1 by the shaft 3, in a forwardly and backwardly pivotable manner, and is pivotably connected at an upper end thereof to a rear end portion of the second base member 8 by the shaft 7. Therefore, the second base member 8 is constructed to be movable forwardly and backwardly in parallel to the first base member 1. A strong first elastic member (spring member) 30 is disposed between the second link member 5 and the second base member 8. The second base member 8 and the second link member 5 are urged by a resilient force of the spring member 30 to pivot about the shaft 7 away from each other. The return springs 13 and 20 have an elastic force set to be smaller than the elastic force of the spring member 30.

Since an end portion of the second base member 8 is connected to an upper end of the first link member 4, the second base member 8 actually cannot pivot upwardly. Therefore, the second base member 8 moves forwardly in parallel to the first base member 1 while pivoting the first link member 4 forwardly, thereby changing the relative positions of the first base member 1 and the second base member 8.

The second link member 5 has a lock member 32 mounted by a shaft 33 on a back surface thereof, which lock member 32 is urged by a spring 31 to pivot downwardly. The lock member 32 constitutes a roof in the running-object configuration and fixes the second link member 5 to prevent pivoting thereof, against an elastic force of the spring member 30, when a mating protrusion 35 formed on a lower surface of the lock member 32 mates with a mating groove 36 formed in an upper surface of the second base member 8, so that the lower surface of the lock member 32 comes into close contact with the upper surface of the second base member 8.

Figure 5A:
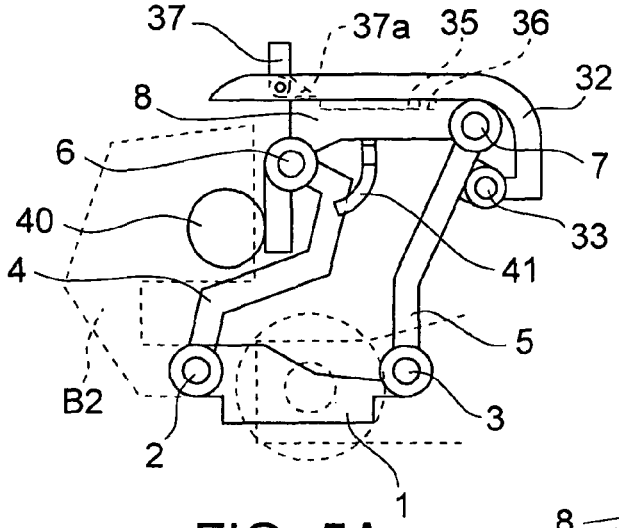
FIGS. 5A to 5D are explanatory diagrams showing a process of transformation.
Figure 5B:
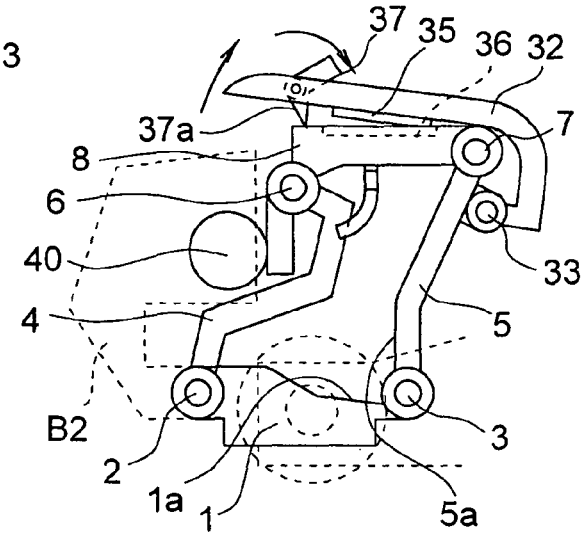

The lock member 32 is provided at a front portion thereof with a lever 37, in a forwardly and backwardly pivotable manner, which is urged by a spring (not shown) so that a claw 37*a* at an end thereof does not protrude downwardly (see FIG. 5A). When the lever 37 is pivoted backwardly against the force of the spring, an end of the claw 37*a* protrudes downwardly and abuts on the upper surface of the second base member 8, whereby the lock member 32 is pivoted upwardly about the shaft 33 and the mating between the mating protrusion 35 and the mating groove 36 is released (see FIG. 5B).

The second base member 8 constitutes a back portion in the robot configuration. The second base member 8 has a head portion 40 of a robot fixed to an end thereof and has at both side portions thereof engaging plates 41, formed in a curved manner, which protrude downwardly and engage with the supporting plates 19. The engaging plates 41 include first engaging portions 41*a*, which are not engaged with the supporting plates 19 while the second base member 8 is at rest (see FIG. 6A) but engage, at ends thereof, directly with back surfaces of the supporting plates 19, forwardly pressing and outwardly pivoting the supporting plates 19 about the shafts 17, at an early stage when the second base member 8 moves forwardly (see FIG. 6B). The engaging plates 41 also include second engaging portions 41*b*, which engage with engaging lugs 22 formed on the back surfaces of the supporting plates 19, pivoting the supporting plates 19 to positions orthogonal to the first link member 4, at a latter-half stage when the second base member 8 moves forwardly (see FIG. 6C).

Figure 5C:
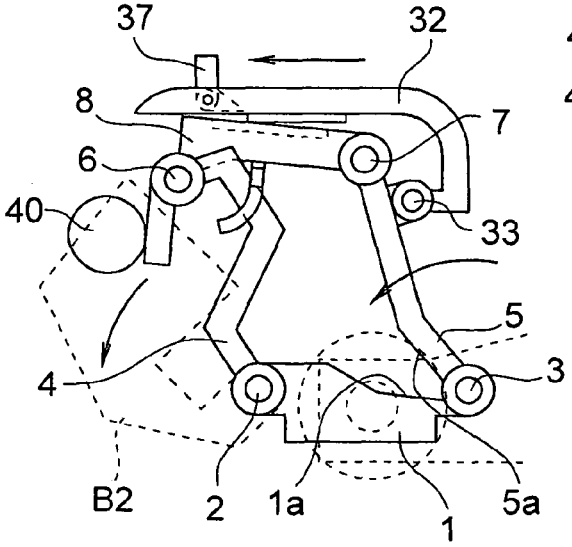

The transformable toy having the above construction is in a running-object configuration, as shown in FIG. 1, when the mating protrusion 35 of the lock member 32 and the mating groove 36 of the second base member 8 are mated with each other and the second link member 5 is prevented from pivoting, as shown in FIG. 5A. In this state, when the lever 37 of the lock member 32 is tilted backwardly and the mating between the mating protrusion 35 and the mating groove 36 is released (see FIG. 5B), the second base member 8 is urged by the spring member 30 and pivots about the shaft 7 away from the second link member 5. However, since the first link member 4 is connected to a front portion of the second base member 8, the second base member 8 begins to move forwardly while being supported by the first link member 4 and the second link member 5 (see FIG. 5C).

Figure 5D:
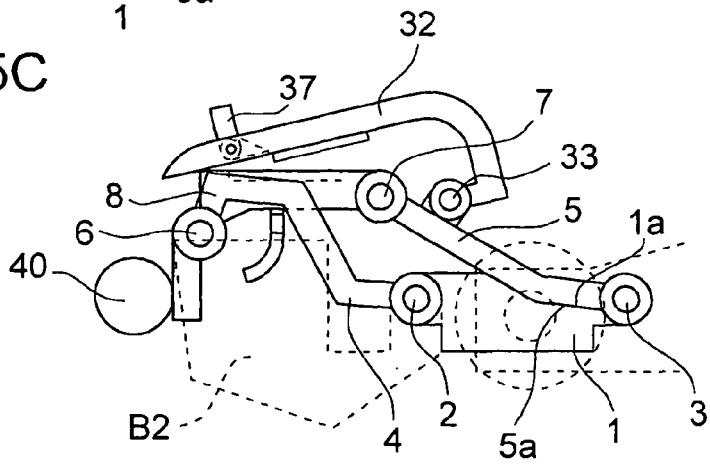

At this time, the chest portion B2 is pressed by the head portion 40 and pivots downwardly about the shaft 2 against the force of the return spring 13, thereby revealing the head portion 40, which has been hidden in the chest portion B2. Moreover, when the second link member 5 has pivoted further until a front surface 5*a* of the second link member 5 abuts on an upper surface la of the first base member 1, the chest portion B2 has rotated by 90 degrees and the head portion 40 protrudes forwardly from the chest portion B2 (see FIG. 5D).

Figure 6B:
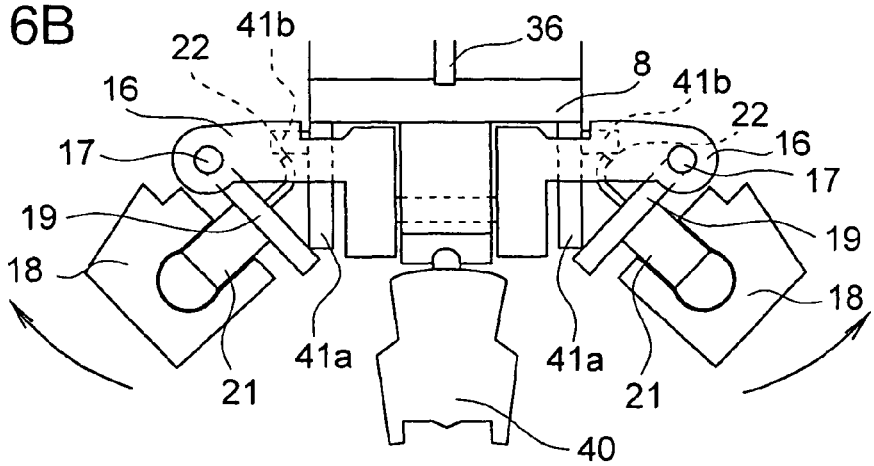
Figure 6C:
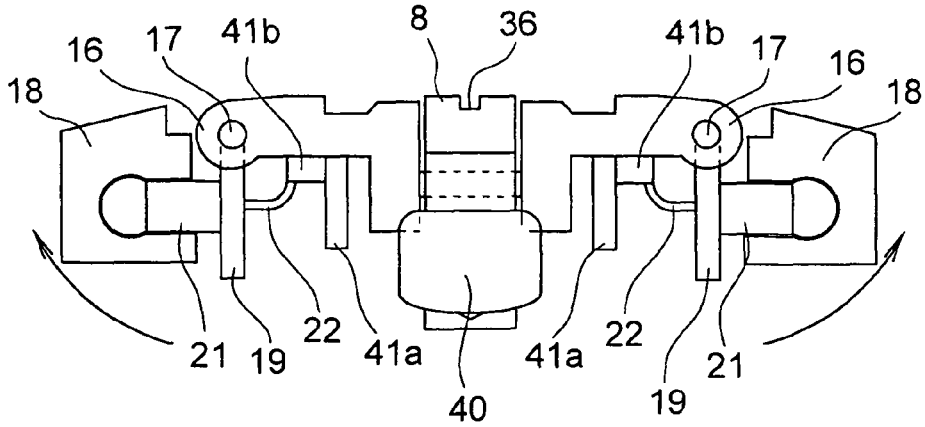

Moreover, when the second base member 8 moves forwardly as described above, the engaging plates 41 formed on the second base member 8 outwardly pivot the supporting plates 19, which are supported on the supporting portions 16 formed on the first link member 4, against the force of the return springs 20, as shown in FIGS. 6B and 6C. Therefore, the arm portions B3 connected by the upper arm portions 18 to the supporting plates 19 move to outside of the chest portion B2, thereby constituting arm portions of the robot, as shown in FIG. 7.

Figure 8:
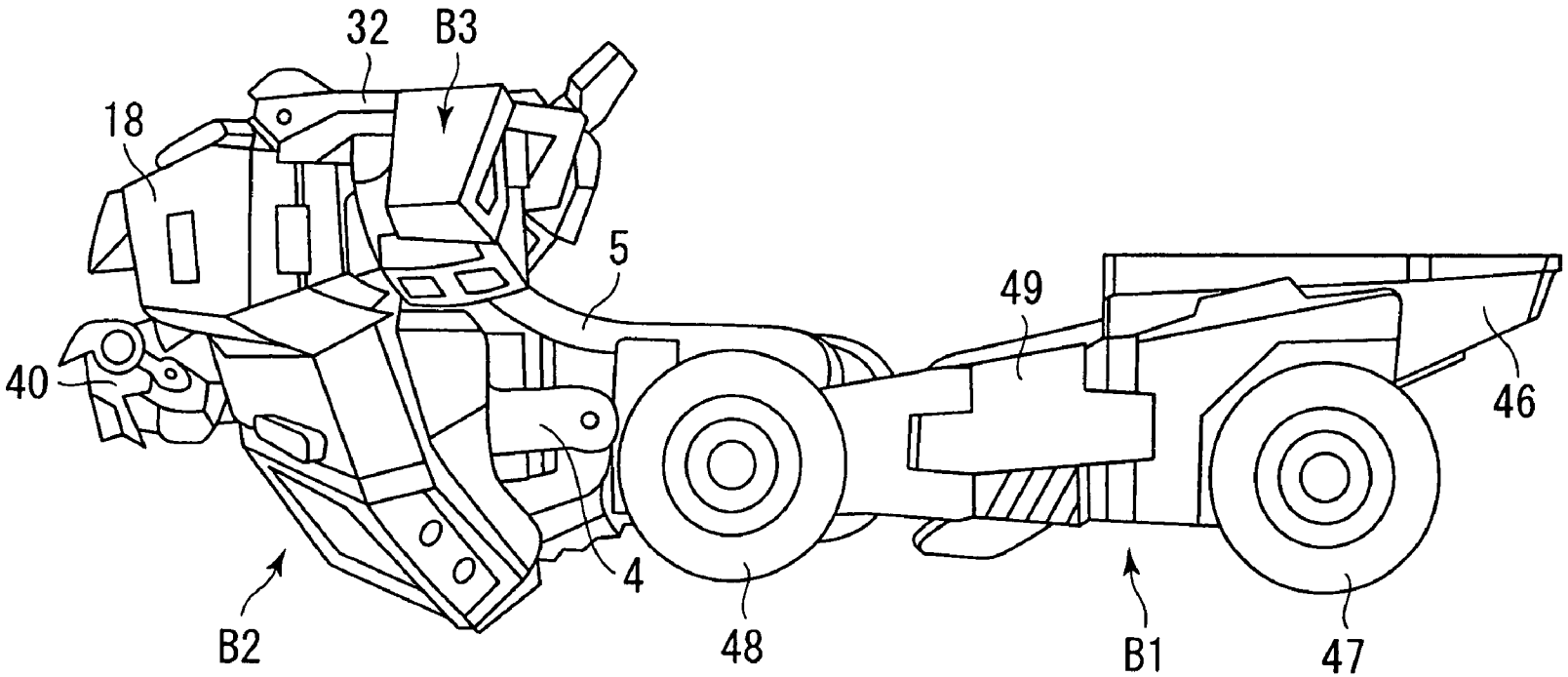
FIG. 8 is a side view showing a state of the transformable toy which has been transformed by the elastic force of the first elastic member.

In this state, as shown in the side view of FIG. 8, the robot is lying with its face down, in which the head portion 40 is exposed and the chest portion B2 constitutes the chest portion in the robot configuration.

Figure 7:
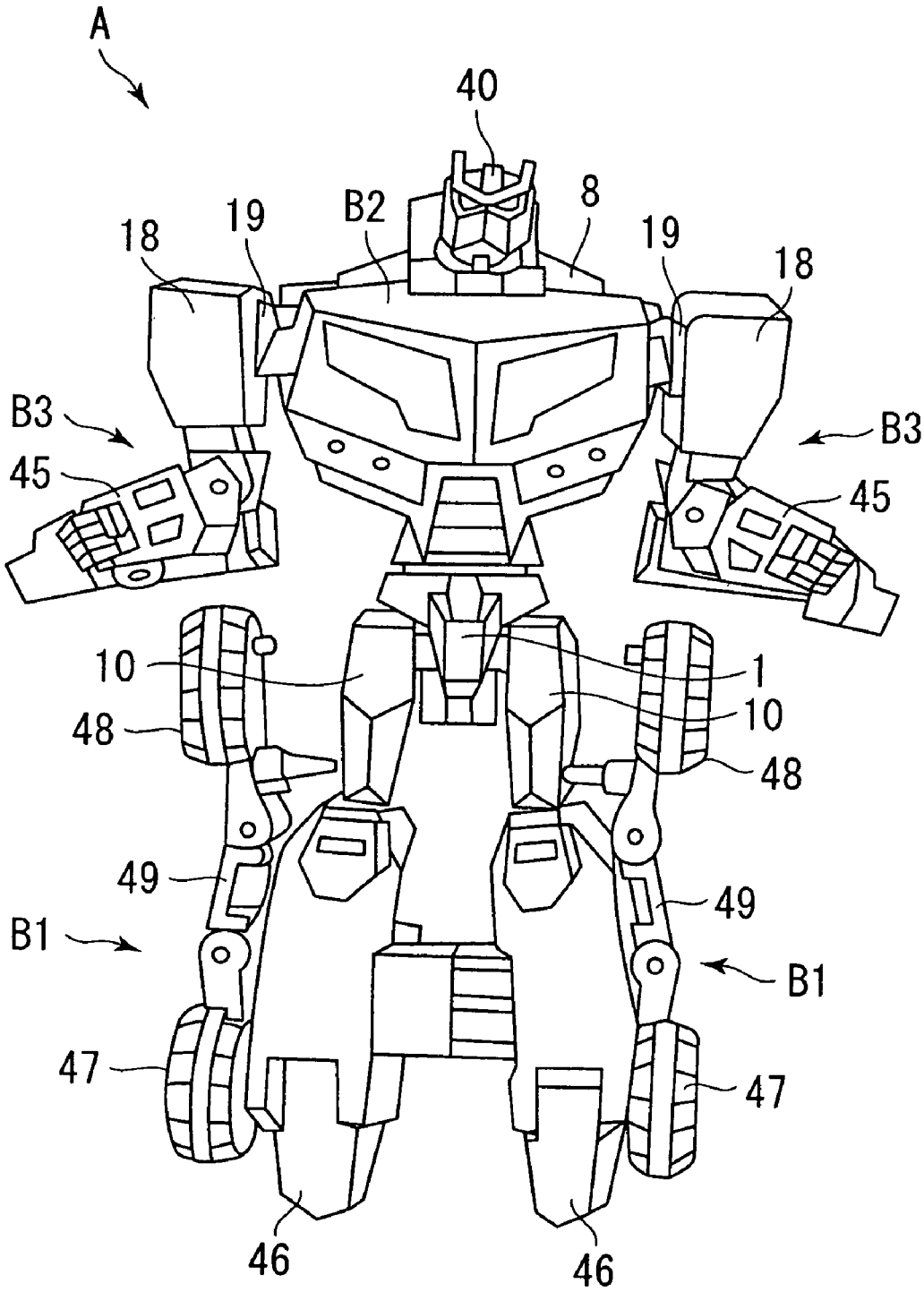
FIG. 7 is a bottom view showing a state of the transformable toy which has been transformed by an elastic force of a first elastic member.

In the states of FIGS. 7 and 8, the transformable toy is in a robot configuration. However, in order to attain a robot configuration closer to a perfect robot, since forearm portions 45 are oriented laterally with respect to the upper arm portions 18, the forearm portions 45 may be pivoted forwardly, foot portions 46 may be pivoted to the front by 90 degrees, and connecting members 49 pivotably connecting rear wheels 47 and front wheels 48 may be folded inwardly. By doing so, the transformable toy can be transformed into a second configuration which is a robot configuration in a complete state, as shown in FIG. 3.

As described above, when the fixed state of the second base member 8 due to the lock member 32 is released, the second base member 8 begins to move forwardly with respect to the first base member 1 by means of the strong elastic force of the first elastic member 30. As a result, the head portion 40 of the robot mounted on the second base member 8 is exposed, the chest portion B2, which constituted a driver's cab, pivots forwardly, thereby constituting a chest portion of the robot, and the engaging plates 41 provided on the second base member 8 outwardly press the arm portions B3 provided on the first link member 4 so as to constitute arm portions in the robot configuration. Thus, it is possible to achieve a transformable toy in which elastic forces of elastic members can be utilized for transformation, without a gear or similar mechanism being provided, and which is automatically transformed despite its structure in which constituent members are pivotably connected as in conventional transformable toys.

Meanwhile, in order to restore the transformable toy from the robot configuration to the running-object configuration, the second base member 8 may be forced backwardly with respect to the first base member 1 against the force of the first elastic member 30. By doing so, the pressing of the chest portion B2 by the head portion 40 is released, and the pressing of the supporting plates 19 by the engaging plates 41 is also released. Therefore, since the respective functions of the return springs 13 and 20 become effective, the chest portion B2 and the arm portions B3 can be automatically restored, without being manually operated, from the chest portion of the robot to the driver's cab of the running object, and from the arm portions of the robot to the bumper of the running object, respectively. Thus, the transformable toy can be readily restored from the second configuration, which is a robot configuration, to the first configuration, which is a running-object configuration.

What is claimed is:

1. A transformable toy reversibly transformed from a first configuration to a second configuration, comprising:

a first base member;

a second base member disposed at a predetermined distance from the first base member;

a first link member for pivotably connecting a front end portion of the first base member and a front end portion of the second base member;

a second link member for pivotably connecting a rear end portion of the first base member and a rear end portion of the second base member;

a first elastic member provided at a connecting portion between at least one of the first link member and the second link member and at least one of the first base member and the second base member, one of said link members being urged to pivot by an elastic force of the first elastic member, relative positions of the first base member and the second base member being changed by pivoting of the one of the link members;

at least one figure member connected to any or all of the first base member, the second base member, the first link member, and the second link member, the at least one figure member expressing a state differing between the first configuration and the second configuration; and a second elastic member provided at a connecting portion between the figure member and the first base member, the second base member, the first link member, or the second link member, the second elastic member acting against the elastic force of the first elastic member, the second elastic member having an elastic force set to be smaller than the elastic force of said first elastic member, wherein the transformable toy is transformed from the first configuration to the second configuration by using the elastic force of the first elastic member.

2. The transformable toy according to claim 1, wherein the first configuration of the transformable toy is a running object;

the second configuration thereof is a robot; the first base member constitutes a waist portion in the robot configuration;

the second base member constitutes a back portion; the second base member has a head portion of the robot at an end thereof;

said at least one figure member includes a pair of first figure members, the pair of first figure members being connected to the first link member and constituting a bumper portion in the running-object configuration, the first figure members each being pivoted outwardly against the force of the second elastic member and constituting an arm portion in the robot configuration, when the second base member moves forwardly;

and said at least one figure member includes a second figure member, the second figure member being connected to the first base member and constituting a front portion in the running-object configuration, the second figure member being pivoted forwardly against the force of another second elastic member and constituting a chest portion in the robot configuration, when the second base member moves forwardly.

3. The transformable toy according to claim 2, wherein each of the first figure members is connected to a supporting plate pivotably supported on the first link member; and the second base member has an engaging plate for engaging with the supporting plate, the engaging plate engaging with the supporting plate and pivoting the supporting plate outwardly, thereby constituting an arm portion in the robot configuration, when the second base member moves forwardly.

4. The transformable toy according to claim 1, further comprising:

a lock member provided in an engageable and disengageable manner, the lock member fixing one of said link members to prevent pivoting thereof, against the elastic force of the first elastic member.

5. The transformable toy according to claim 2, further comprising:

a lock member provided in an engageable and disengageable manner, the lock member fixing one of said link members to prevent pivoting thereof, against the elastic force of the first elastic member.

* * * * *